US007438052B2

(12) United States Patent
Awano et al.

(10) Patent No.: US 7,438,052 B2
(45) Date of Patent: Oct. 21, 2008

(54) ABNORMALITY-DETERMINING DEVICE AND METHOD FOR FUEL SUPPLY SYSTEM, AND ENGINE CONTROL UNIT

(75) Inventors: Koichi Awano, Saitama-ken (JP); Atsushi Izumiura, Saitama-ken (JP); Daisuke Sato, Saitama-ken (JP)

(73) Assignee: Honda Motor Co., Ltd., Tokyo (JP)

( * ) Notice: Subject to any disclaimer, the term of this patent is extended or adjusted under 35 U.S.C. 154(b) by 43 days.

(21) Appl. No.: 11/714,154

(22) Filed: Mar. 6, 2007

(65) Prior Publication Data

US 2007/0209430 A1 Sep. 13, 2007

(30) Foreign Application Priority Data

Mar. 8, 2006 (JP) ..... 2006-062307

(51) Int. Cl.
*F02M 69/46* (2006.01)
*F02M 69/52* (2006.01)

(52) U.S. Cl. ..... 123/456; 123/198 D

(58) Field of Classification Search ..... 123/456, 123/447, 446, 198 D, 514, 506, 508, 198 DB; 73/118.1, 119 A See application file for complete search history.

(56) References Cited

U.S. PATENT DOCUMENTS

| | | | | |
|---|---|---|---|---|
| 5,773,716 | A * | 6/1998 | Antonioli et al. | 73/114.51 |
| 7,143,747 | B2 * | 12/2006 | Uchiyama | 123/456 |
| 2006/0054149 | A1 * | 3/2006 | Uchiyama | 123/676 |
| 2006/0213482 | A1 * | 9/2006 | Shibagaki et al. | 123/396 |

* cited by examiner

*Primary Examiner*—Mahmoud Gimie
(74) *Attorney, Agent, or Firm*—Arent Fox LLP

(57) ABSTRACT

A device for determining abnormality of a fuel supply system, which is capable of determining abnormality of the fuel supply system including a fuel pressure sensor more accurately. A device for determining abnormality of a fuel supply system that has a fuel pressure sensor for detecting pressure of fuel in an accumulator as detected fuel pressure calculates a predetermined normal-time fuel pressure indicative of pressure fuel in the accumulator which is to be detected when the system is normal, according to a fuel flow rate relationship parameter indicative of a relationship between an inflow fuel amount parameter indicative of an amount of fuel flowing into the accumulator and an outflow fuel amount parameter indicative of an amount of fuel flowing out of the accumulator, and determines abnormality of the fuel supply system based on a result of comparison between the detected fuel pressure and the calculated normal-time fuel pressure.

18 Claims, 7 Drawing Sheets

ABNORMALITY-DETERMINING DEVICE AND METHOD FOR FUEL SUPPLY SYSTEM, AND ENGINE CONTROL UNIT

BACKGROUND OF THE INVENTION

1. Field of the Invention

This invention relates to a device and method and an engine control unit for determining abnormality of a fuel supply system that supplies fuel stored under pressure in an accumulator to an internal combustion engine and is provided with a fuel pressure sensor for detecting the pressure of the fuel in the accumulator.

2. Description of the Related Art

Conventionally, this kind of device for determining abnormality of a fuel supply system is disclosed in Japanese Laid-Open Patent Publication (Kokai) No. 2000-161172. The fuel supply system supplies fuel under pressure by a fuel pump into an accumulator, and detects the pressure of the fuel in the accumulator using a fuel pressure sensor. Further, the fuel supply system determines indicated pressure for the accumulator, and controls the fuel pump such that the fuel pressure detected by the fuel pressure sensor (hereinafter referred to as "the detected fuel pressure) becomes equal to the indicated pressure. Further, the abnormality-determining device determines that the fuel pressure sensor is abnormal when the difference between the indicated pressure and the detected fuel pressure is large.

However, since the conventional abnormality-determining device determines abnormality of the fuel pressure sensor based on the result of comparison between the detected fuel pressure and the indicated pressure, there is a fear that the abnormality is erroneously determined. For example, when an abnormality, such as cracking of the accumulator, occurs, causing the actual fuel pressure in the accumulator to largely drop, the detected fuel pressure becomes much lower than the indicated pressure, even though the fuel pressure sensor is normal. As a result, it is erroneously determined that the fuel pressure sensor is abnormal.

SUMMARY OF THE INVENTION

The present invention has been made to provide a solution to the above-described problem, and an object thereof is to provide a device and method and an engine control unit for determining abnormality of a fuel supply system, which are capable of determining abnormality of the fuel supply system including a fuel pressure sensor with higher accuracy.

To attain the above object, in a first aspect of the present invention, there is provided a device for determining abnormality of a fuel supply system that supplies fuel in a fuel tank to an accumulator via a fuel pump, and supplies fuel stored under pressure in the accumulator to an internal combustion engine, the fuel supply system including a relief mechanism for returning fuel in the accumulator to the fuel tank, and a fuel pressure sensor for detecting the pressure of the fuel in the accumulator as detected fuel pressure. The abnormality-determining device according to the first aspect of the present invention is characterized by comprising inflow fuel amount parameter-detecting means for detecting an inflow fuel amount parameter indicative of an inflow fuel amount of fuel flowing into the accumulator from the fuel tank, outflow fuel amount parameter-detecting means for detecting an outflow fuel amount parameter indicative of an outflow fuel amount of fuel flowing out of the accumulator into the fuel tank, fuel flow rate relationship parameter-calculating means for calculating a fuel flow rate relationship parameter indicative of a relationship between the inflow fuel amount parameter and the outflow fuel amount parameter, normal-time fuel pressure-calculating means for calculating a normal-time fuel pressure indicative of a pressure of fuel in the accumulator which is to be detected when the fuel supply system is normal, according to the calculated fuel flow rate relationship parameter, and abnormality determining means for determining abnormality of the fuel supply system, based on a result of comparison between the detected fuel pressure detected by the fuel pressure sensor and the calculated normal-time fuel pressure.

With the configuration of the device for determining abnormality of a fuel supply system, the inflow fuel amount parameter indicative of the amount of fuel flowing into the accumulator from the fuel tank is calculated by the inflow fuel amount parameter-calculating means, while the outflow fuel amount parameter indicative of the amount of fuel flowing out of the accumulator into the fuel tank is calculated by the outflow fuel amount parameter-calculating means. The fuel flow rate relationship parameter indicative of the relationship between the inflow fuel amount parameter and the outflow fuel amount parameter is calculated by the fuel flow rate relationship parameter-calculating means. Further, the normal-time fuel pressure indicative of the pressure of fuel in the accumulator which is to be detected when the fuel supply system is normal is calculated by the normal-time fuel pressure-calculating means according to the calculated fuel flow rate relationship parameter. Further, the abnormality of the fuel supply system is determined by the abnormality determining means based on the result of comparison between the detected fuel pressure and the calculated normal-time fuel pressure.

There is a close relationship between the inflow fuel amount of fuel flowing into the accumulator and the outflow fuel amount of fuel flowing out of the accumulator, and the concurrently detected pressure of fuel in the accumulator. When the fuel supply system is normal, the fuel pressure can be determined according to the inflow fuel amount and the outflow fuel amount. This enables the normal-time fuel pressure, which is to be detected when the fuel supply system is normal, to be properly calculated based on the fuel flow rate relationship parameter indicative of the relationship between the inflow fuel amount parameter and the outflow fuel amount parameter. When the fuel supply system is abnormal, there occurs an increase in the difference between the fuel pressure detected by the fuel pressure sensor and the normal-time fuel pressure, and therefore, based on the result of comparison between the detected fuel pressure and the normal-time fuel pressure, it is possible to accurately determine the abnormality of the fuel supply system.

Preferably, the device further comprises operative state-determining means for determining which of a normal operation in which the fuel supply system supplies fuel to the engine and a fuel-cut operation in which the supply of fuel to the engine is inhibited the engine is in, and the normal-time fuel pressure-calculating means calculates the normal-time fuel pressure according to the determined operative state of the engine.

During fuel-cut (hereinafter referred to as "F/C") operation, the fuel in the accumulator is inhibited from being supplied to the engine, but held therein, and hence the relationship between the fuel pressure in the accumulator and the inflow fuel amount and the outflow fuel amount during the F/C operation is different from that during the normal operation. With the configuration of this preferred embodiment, the normal-time fuel pressure is calculated according to the operative state of the engine concerning whether the engine is in the F/C operation or not. This enables accurate determination of the abnormality according to the operative state of the engine.

To attain the above object, in a second aspect of the present invention, there is provided a device for determining abnormality of a fuel supply system that supplies fuel in a fuel tank to an accumulator via a fuel pump, and supplies fuel stored under pressure in the accumulator to an internal combustion engine, the fuel supply system including a relief mechanism for returning fuel in the accumulator to the fuel tank, and a fuel pressure sensor for detecting the pressure of the fuel in the accumulator as detected fuel pressure. The abnormality-determining device according to the second aspect of the invention is characterized by comprising inflow fuel amount parameter-detecting means for detecting an inflow fuel amount parameter indicative of an inflow fuel amount of fuel flowing into the accumulator from the fuel tank, outflow fuel amount parameter-detecting means for detecting an outflow fuel amount parameter indicative of an outflow fuel amount of fuel flowing out of the accumulator into the fuel tank, fuel flow rate relationship parameter-calculating means for calculating a fuel flow rate relationship parameter indicative of a relationship between the inflow fuel amount parameter and the outflow fuel amount parameter, detected pressure curve-calculating means for calculating a detected pressure curve indicative of a relationship between the fuel flow rate relationship parameter and the detected fuel pressure, based on a plurality of detected fuel pressures detected by the fuel pressure sensor, and the fuel flow rate relationship parameters which are calculated when the detected fuel pressures are detected, respectively, normal-time pressure curve-setting means for setting a predetermined normal-time pressure curve indicative of a relationship between the fuel flow rate relationship parameter and a normal-time fuel pressure indicative of a pressure of fuel in the accumulator which is to be detected when the fuel supply system is normal, and abnormality determining means for determining abnormality of the fuel supply system, based on a result of comparison between the detected fuel pressure curve and the normal-time pressure curve.

With the configuration of the device for determining abnormality of a fuel supply system, the detected fuel pressure curve indicative of a relationship between the fuel flow rate relationship parameter and the detected fuel pressure is calculated based on a plurality of detected fuel pressures by the detected fuel pressure curve-calculating means. Further, the predetermined normal-time pressure curve indicative of the relationship between the fuel flow rate relationship parameter and the normal-time fuel pressure is set by the normal-time pressure curve-setting means. Then, the abnormality of the fuel supply system is determined based on the result of comparison between the normal-time pressure curve and the detected pressure curve.

As described above, the detected pressure curve is calculated based on the plurality of detected fuel pressures, and hence excellently represents the overall relationship of the detected fuel pressure with respect to the fuel flow rate relationship parameter. Therefore, by determining the abnormality based on the result of comparison between the calculated detected pressure curve and the normal-time pressure curve set in advance with respect to the fuel flow rate relationship parameter, it is possible to determine the determination more accurately while excluding the direct affects of temporary fluctuations in the outflow fuel amount and the fuel pressure, and temporary errors in the detected fuel pressure PF.

Preferably, the device further comprises operative state-determining means for determining which of a normal operation in which the fuel supply system supplies fuel to the engine and a fuel-cut operation in which the supply of fuel to the engine is inhibited the engine is in, and the detected pressure curve-calculating means calculates the detected fuel pressure curve, on an operative state-by-operative state basis, according to the operative state determined by the operative state-determining means when the detected fuel pressure is detected, the normal-time pressure curve-setting means setting the normal-time pressure curve, on an operative state-by-operative state basis, and the abnormality determining means comparing between one of the detected pressure curves and one of the normal-time pressure curves, the ones corresponding to each other in respect of the operative state of the engine.

As described above, the relationship of the fuel pressure in the accumulator with respect to the inflow fuel amount and the outflow fuel amount changes depending on the operative state of the engine concerning whether it is in F/C operation. Therefore, by determining the normal-time pressure curve and the detected pressure curve, on an operative state-by-operative state basis, and comparing between ones of the curves corresponding to each other in respect of the operative state, it is possible to accurately perform the abnormality determination according to the operative state of the engine.

Preferably, the device further comprises normal-time pressure region-setting means for setting a predetermined normal-time pressure region including the normal-time pressure curve, based on the normal-time pressure curve, and the abnormality determining means determines that the fuel supply system is abnormal when at least part of the detected pressure curve is outside the normal-time pressure region.

Even if the fuel supply system is abnormal, the fuel pressure in the accumulator sometimes varies within a certain range. Therefore, as described above, when at least part of the detected pressure curve is outside the normal-time pressure region set based on the normal-time pressure curve, it is determined that the fuel supply system is abnormal, whereby the abnormality determination can be accurately carried out while taking the variation in the fuel pressure into account.

More preferably, the normal-time pressure region has a range of pressure set according to the fuel flow rate relationship parameter.

The range of variation in the fuel pressure in the accumulator changes depending on the relationship between the inflow fuel amount and the outflow fuel amount, but is not necessarily constant. Therefore, by setting the range of pressure in the normal-time pressure region according to the fuel flow rate relationship parameter, as mentioned above, it is possible to carry out the abnormality determination more accurately.

To attain the above object, in a third aspect of the present invention, there is provided a method of determining abnormality of a fuel supply system that supplies fuel in a fuel tank to an accumulator via a fuel pump, and supplies fuel stored under pressure in the accumulator to an internal combustion engine, the fuel supply system including a relief mechanism for returning fuel in the accumulator to the fuel tank, and a fuel pressure sensor for detecting the pressure of the fuel in the accumulator as detected fuel pressure. The abnormality-determining method according to the third aspect of the present invention is characterized by comprising an inflow fuel amount parameter-detecting step of detecting an inflow fuel amount parameter indicative of an inflow fuel amount of fuel flowing into the accumulator from the fuel tank, an outflow fuel amount parameter-detecting step of detecting an outflow fuel amount parameter indicative of an outflow fuel amount of fuel flowing out of the accumulator into the fuel tank, a fuel flow rate relationship parameter-calculating step of calculating a fuel flow rate relationship parameter indicative of a relationship between the inflow fuel amount parameter and the outflow fuel amount parameter, a normal-time fuel pressure-calculating step of calculating a normal-time fuel pressure indicative of a pressure of fuel in the accumulator which is to be detected when the fuel supply system is normal, according to the calculated fuel flow rate relationship parameter, and an abnormality determining step of determining abnormality of the fuel supply system, based on a result of comparison between the detected fuel pressure detected by the fuel pressure sensor and the calculated normal-time fuel pressure.

With the configuration of the third aspect of the present invention, it is possible to obtain the same advantageous effects as provided by the first aspect of the present invention.

Preferably, the method further comprises an operative state-determining step of determining which of a normal operation in which the fuel supply system supplies fuel to the engine and a fuel-cut operation in which the supply of fuel to the engine is inhibited the engine is in, and the normal-time fuel pressure-calculating step includes calculating the normal-time fuel pressure according to the determined operative state of the engine.

With the configuration of the preferred embodiment, it is possible to obtain the same advantageous effects as provided by the preferred embodiment of the first aspect of the present invention.

To attain the above object, in a fourth aspect of the present invention, there is provided a method of determining abnormality of a fuel supply system that supplies fuel in a fuel tank to an accumulator via a fuel pump, and supplies fuel stored under pressure in the accumulator to an internal combustion engine, the fuel supply system including a relief mechanism for returning fuel in the accumulator to the fuel tank, and a fuel pressure sensor for detecting the pressure of the fuel in the accumulator as detected fuel pressure. The abnormality-determining method according to the fourth aspect of the present invention is characterized by comprising an inflow fuel amount parameter-detecting step of detecting an inflow fuel amount parameter indicative of an inflow fuel amount of fuel flowing into the accumulator from the fuel tank, an outflow fuel amount parameter-detecting step of detecting an outflow fuel amount parameter indicative of an outflow fuel amount of fuel flowing out of the accumulator into the fuel tank, a fuel flow rate relationship parameter-calculating step of calculating a fuel flow rate relationship parameter indicative of a relationship between the inflow fuel amount parameter and the outflow fuel amount parameter, a detected pressure curve-calculating step of calculating a detected pressure curve indicative of a relationship between the fuel flow rate relationship parameter and the detected fuel pressure, based on a plurality of detected fuel pressures detected by the fuel pressure sensor, and the fuel flow rate relationship parameters which are calculated when the detected fuel pressures are detected, respectively, a normal-time pressure curve-setting step of setting a predetermined normal-time pressure curve indicative of a relationship between the fuel flow rate relationship parameter and a normal-time fuel pressure indicative of a pressure of fuel in the accumulator which is to be detected when the fuel supply system is normal, and an abnormality determining step of determining abnormality of the fuel supply system, based on a result of comparison between the detected fuel pressure curve and the normal-time pressure curve.

With the configuration of the fourth aspect of the present invention, it is possible to obtain the same advantageous effects as provided by the second aspect of the present invention.

Preferably, the method further comprises an operative state-determining step of determining which of a normal operation in which the fuel supply system supplies fuel to the engine and a fuel-cut operation in which the supply of fuel to the engine is inhibited the engine is in, and the detected pressure curve-calculating step includes calculating the detected fuel pressure curve, on an operative state-by-operative state basis, according to the operative state determined in the operative state-determining step when the detected fuel pressure is detected, the normal-time pressure curve-setting step including setting the normal-time pressure curve, on an operative state-by-operative state basis, the abnormality determining step including comparing between one of the detected pressure curves and one of the normal-time pressure curves, the ones corresponding to each other in respect of the operative state of the engine.

Preferably, the method further comprises a normal-time pressure region-setting step of setting a predetermined normal-time pressure region including the normal-time pressure curve, based on the normal-time pressure curve, and the abnormality determining step includes determining that the fuel supply system is abnormal when at least part of the detected pressure curve is outside the normal-time pressure region.

More preferably, the normal-time pressure region has a range of pressure set according to the fuel flow rate relationship parameter.

With the configurations of these preferred embodiments, it is possible to obtain the same advantageous effects as provided by the corresponding preferred embodiments of the second aspect of the present invention.

To attain the above object, in a fifth aspect of the present invention, there is provided an engine control unit including a control program for causing a computer to determine abnormality of a fuel supply system that supplies fuel in a fuel tank to an accumulator via a fuel pump, and supplies fuel stored under pressure in the accumulator to an internal combustion engine, the fuel supply system including a relief mechanism for returning fuel in the accumulator to the fuel tank, and a fuel pressure sensor for detecting the pressure of the fuel in the accumulator as detected fuel pressure. The engine control unit according to the fifth aspect of the present invention is characterized in that the control program causes the computer to detect an inflow fuel amount parameter indicative of an inflow fuel amount of fuel flowing into the accumulator from the fuel tank, detect an outflow fuel amount parameter indicative of an outflow fuel amount of fuel flowing out of the accumulator into the fuel tank, calculate a fuel flow rate relationship parameter indicative of a relationship between the inflow fuel amount parameter and the outflow fuel amount parameter, calculate a normal-time fuel pressure indicative of a pressure of fuel in the accumulator which is to be detected when the fuel supply system is normal, according to the calculated fuel flow rate relationship parameter, and determine abnormality of the fuel supply system, based on a result of comparison between the detected fuel pressure detected by the fuel pressure sensor and the calculated normal-time fuel pressure.

With the configuration of the fifth aspect of the present invention, it is possible to obtain the same advantageous effects as provided by the first aspect of the present invention.

Preferably, the control program causes the computer to determine which of a normal operation in which the fuel supply system supplies fuel to the engine and a fuel-cut operation in which the supply of fuel to the engine is inhibited the engine is in, and when the control program causes the computer to calculate the normal-time fuel pressure, the control program causes the computer to calculate the normal-time fuel pressure according to the determined operative state of the engine.

With the configuration of the preferred embodiment, it is possible to obtain the same advantageous effects as provided by the preferred embodiment of the first aspect of the present invention.

To attain the above object, in a sixth aspect of the present invention, there is provided an engine control unit including a control program for causing a computer to determine abnormality of a fuel supply system that supplies fuel in a fuel tank to an accumulator via a fuel pump, and supplies fuel stored under pressure in the accumulator to an internal combustion engine, the fuel supply system including a relief mechanism for returning fuel in the accumulator to the fuel tank, and a fuel pressure sensor for detecting the pressure of the fuel in the accumulator as detected fuel pressure. The engine control unit according to the sixth aspect of the present invention is characterized in that the control program causes the computer to detect an inflow fuel amount parameter indicative of an inflow fuel amount of fuel flowing into the accumulator from the fuel tank, detect an outflow fuel amount parameter indicative of an outflow fuel amount of fuel flowing out of the accumulator into the fuel tank, calculate a fuel flow rate relationship parameter indicative of a relationship between the inflow fuel amount parameter and the outflow fuel amount parameter, calculate a detected pressure curve indicative of a relationship between the fuel flow rate relationship parameter and the detected fuel pressure, based on a plurality of detected fuel pressures detected by the fuel pressure sensor, and the fuel flow rate relationship parameters which are calculated when the detected fuel pressures are detected, respectively, set a predetermined normal-time pressure curve indicative of a relationship between the fuel flow rate relationship parameter and a normal-time fuel pressure indicative of a pressure of fuel in the accumulator which is to be detected when the fuel supply system is normal, and determine abnormality of the fuel supply system, based on a result of comparison between the detected fuel pressure curve and the normal-time pressure curve.

With the configuration of the sixth aspect of the present invention, it is possible to obtain the same advantageous effects as provided by the second aspect of the present invention.

Preferably, the control program causes the computer to determine which of a normal operation in which the fuel supply system supplies fuel to the engine and a fuel-cut operation in which the supply of fuel to the engine is inhibited the engine is in, and when the control program causes the computer to calculate the detected pressure curve, the control program causes the computer to calculate the detected fuel pressure curve, on an operative state-by-operative state basis, according to the operative state determined by the operative state-determining means when the detected fuel pressure is detected; when the control program causes the computer to set the normal-time pressure curve, the control program causes the computer to set the normal-time pressure curve, on an operative state-by-operative state basis; and when the control program causes the computer to determine the abnormality, the control program causes the computer to compare between one of the detected pressure curves and one of the normal-time pressure curves, the ones corresponding to each other in respect of the operative state of the engine.

Preferably, the control program causes the computer to set a predetermined normal-time pressure region including the normal-time pressure curve, based on the normal-time pressure curve, and when the control program causes the computer to determine the abnormality, the control program causes the computer to determine that the fuel supply system is abnormal when at least part of the detected pressure curve is outside the normal-time pressure region.

More preferably, the normal-time pressure region has a range of pressure set according to the fuel flow rate relationship parameter.

With the configurations of these preferred embodiments, it is possible to obtain the same advantageous effects as provided by the corresponding preferred embodiments of the second aspect of the present invention.

The above and other objects, features, and advantages of the present invention will become more apparent from the following detailed description taken in conjunction with the accompanying drawings.

DETAILED DESCRIPTION OF PREFERRED EMBODIMENTS

Figure 1:
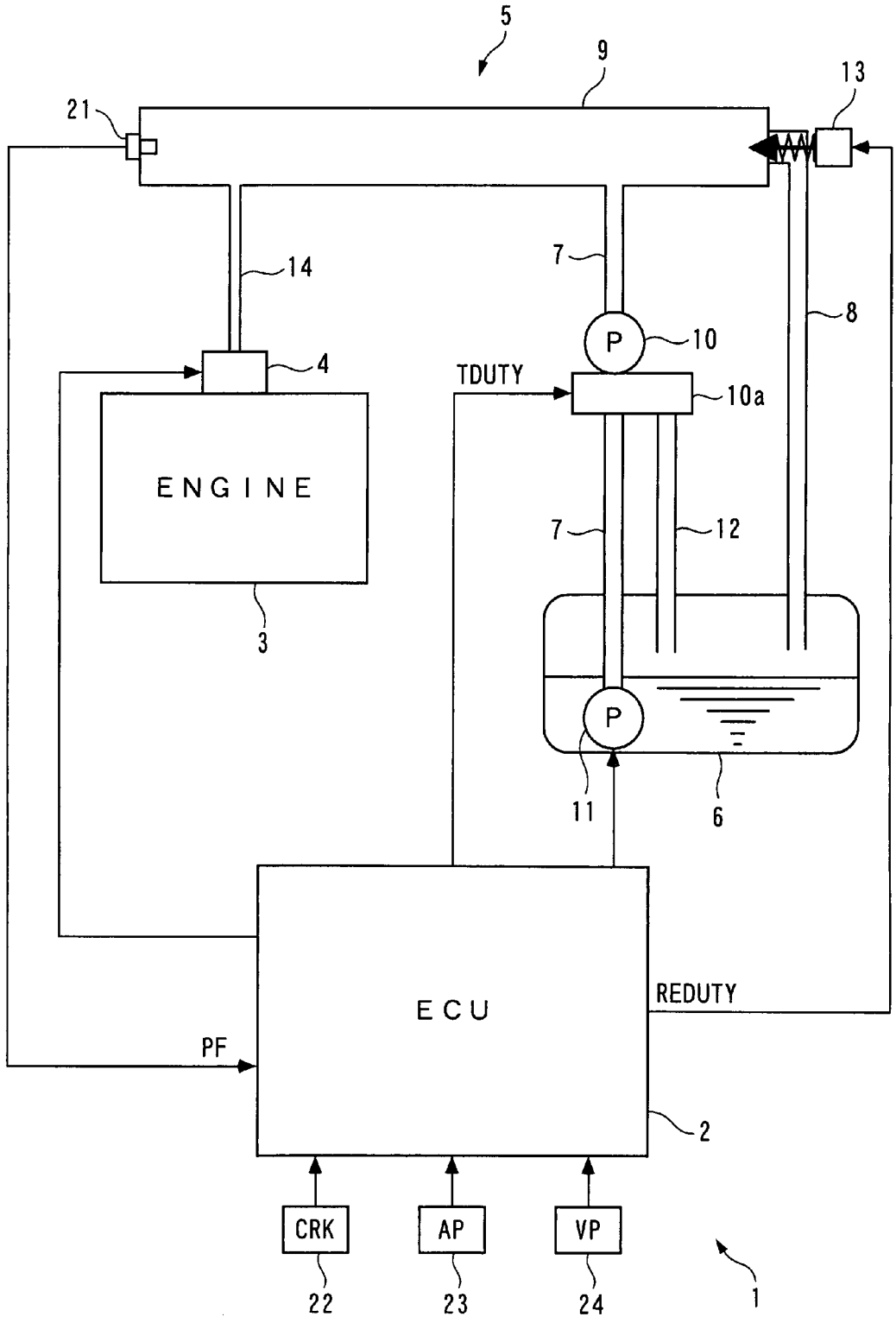
FIG. 1 is a schematic block diagram of an abnormality-determining device according to an embodiment of the present invention, together with an internal combustion engine to which the invention is applied.

The present invention will now be described in detail with reference to the drawings showing preferred embodiments thereof. Referring first to FIG. 1, there is schematically shown the arrangement of an internal combustion engine 3 to which is applied an abnormality-determining device according to an embodiment of the present invention. The internal combustion engine 3 (hereinafter simply referred to as "the engine") is a diesel engine e.g. of a four-cylinder type, and installed on an automotive vehicle (not shown).

The engine 3 has injectors 4 (fuel supply system; only one of them is shown) provided for respective associated ones of cylinders, not shown, thereof. The injectors 4 are connected to a fuel supply apparatus 5 (fuel supply system), and injects fuel supplied from the fuel supply apparatus 5 into the respective associated cylinders. Further, a fuel injection amount QINJ of fuel injected by each injector 4 is controlled by a drive signal delivered thereto from an ECU 2, referred to hereinafter.

The fuel supply apparatus 5 is comprised of a fuel tank 6 storing fuel, a common rail 9 (accumulator) that is connected to the fuel tank 6 via a fuel supply passage 7 and a fuel return passage 8 (relief mechanism), and stores fuel under high pressure, and a high-pressure pump 10 (fuel pump) provided in an intermediate portion of the fuel supply passage 7.

The fuel tank 6 is provided with a low-pressure pump 11 (fuel pump). The low-pressure pump 11 is an electric pump whose operation is controlled by the ECU 2. The low-pressure pump 11 is constantly controlled during operation of the engine 3 to pressurize fuel within the fuel tank 6 to a predetermined pressure and supplies the pressurized fuel to the high-pressure pump 10 via the fuel supply passage 7.

The high-pressure pump 10 is provided with a fuel metering valve 10*a*. The fuel metering valve 10*a*, which is a combination of a solenoid and a spool valve mechanism, adjusts the amount of fuel supplied from the low-pressure pump 11 to the high-pressure pump 10 and returns unnecessary fuel to the fuel tank 6 via a fuel return passage 12. The amount of fuel supplied to the high-pressure pump 10 and the amount of fuel returned to the fuel tank 6 are changed by controlling the duty ratio TDUTY (hereinafter referred to as "the metering valve duty ratio") of electric current supplied to the fuel metering valve 10*a*, using the ECU 2. It should be noted that the amount of fuel supplied to the high-pressure pump 10 is smaller as the metering duty ratio TDUTY is higher.

The high-pressure pump 10 is of a displacement type and is connected to a crankshaft (not shown), for being driven thereby to further pressurize the fuel from the fuel metering valve 10*a* and deliver the fuel to the common rail 9.

A portion of the common rail 9 via which the common rail 9 is connected to the fuel return passage 8 is provided with an electromagnetic relief valve 13 (relief mechanism). The electromagnetic relief valve 13 is formed by a normally-open electromagnetic valve, and the valve opening degree of the electromagnetic relief valve 13 is linearly changed by controlling the duty ratio (hereinafter referred to as "the relief valve duty ratio") REDUTY of electric current supplied thereto by the ECU 2, to thereby control the amount of fuel returned from the common rail 9 to the fuel tank 6. It should be noted that since the electromagnetic relief valve 13 is normally open, as the relief valve duty ratio REDUTY is higher, the valve opening degree thereof becomes smaller to reduce the amount of fuel returned to the fuel tank 6.

In the fuel supply apparatus 5 constructed as above, the amount of fuel (hereinafter referred to as "the inflow fuel amount") flowing into the common rail 9 is controlled by the metering valve duty ratio TDUTY, and the amount of fuel (hereinafter referred to as "the outflow fuel amount") flowing out from the common rail 9 is controlled by the relief valve duty ratio REDUTY, whereby the pressure of fuel in the common rail 9 is controlled. This causes fuel to be stored in the common rail 9 in a highly-pressurized state. Further, the fuel within the common rail 9 is supplied to each injector 4 via a fuel injection passage 14.

Further, the common rail 9 has a fuel pressure sensor 21 inserted therein. The fuel pressure sensor 21 detects the pressure of fuel in the common rail 9 (hereinafter simply referred to as "the fuel pressure") as detected fuel pressure PF, and delivers a detection signal indicative thereof to the ECU 2. Hereinafter, the fuel pressure sensor 21, the fuel supply apparatus 5, and the injectors 4 are collectively referred to as "the fuel supply system".

The engine 3 is provided with a crank angle sensor 22. The crank angle sensor 22 is formed by a combination of a magnet rotor and an MRE pickup, and delivers a CRK signal and a TDC signal, which are both pulse signals, to the ECU 2 in accordance with rotation of the crankshaft. Each pulse of the CRK signal is generated whenever the crankshaft rotates through a predetermined angle (e.g. 10°). The ECU 2 determines a rotational speed (hereinafter referred to as "the engine speed") NE of the engine 3, based on the CRK signal. The TDC signal indicates that a piston of the engine 3 (not shown) has come to a predetermined crank angle position immediately before the TDC position at the start of the intake stroke, on a cylinder-by-cylinder basis, and each pulse of the TDC signal is generated whenever the crankshaft rotates through a predetermined angle.

Further, an accelerator opening sensor 23 detects, and delivers a detection signal indicative of the stepped-on amount (hereinafter referred to as "the accelerator opening degree") AP of an accelerator pedal, not shown, to the ECU 2, and a vehicle speed sensor 24 delivers a detection signal indicative of vehicle speed VP to the same.

The ECU 2 is implemented by a microcomputer comprised of an I/O interface, a CPU, a RAM, and a ROM. The ECU 2 determines operating conditions of the engine based on the detection signals received from the aforementioned sensors 21 to 24, and carries out engine control including control of the amount of fuel to be injected by each injector 4, and an abnormality-determining process for determining abnormality of the fuel supply system. It should be noted that in the present embodiment, the ECU 2 corresponds to inflow fuel amount parameter-detecting means, outflow fuel amount parameter-detecting means, fuel flow rate relationship parameter-calculating means, normal-time fuel pressure-calculating means, abnormality determining means, operative state-determining means, detected pressure curve-calculating means, normal-time pressure curve-setting means, and normal-time pressure region-setting means.

Further, the ECU 2 controls the fuel injection amount QINJ to a value of 0 during deceleration e.g. when the accelerator opening degree AP is approximately equal to a predetermined opening (e.g. 0°), and at the same time the engine speed NE is higher than a predetermined engine speed (e.g. 1000 rpm), thereby executing fuel-cut (hereinafter referred to as "F/C") operation for inhibiting the fuel supply. During the F/C operation, since the fuel injection by each injector 4 is not performed, the relief valve duty ratio REDUTY is set to a lower value than that during normal operation other than the F/C operation, whereby the valve opening degree of the electromagnetic relief valve 13 is increased to increase the outflow fuel amount.

Figure 2:
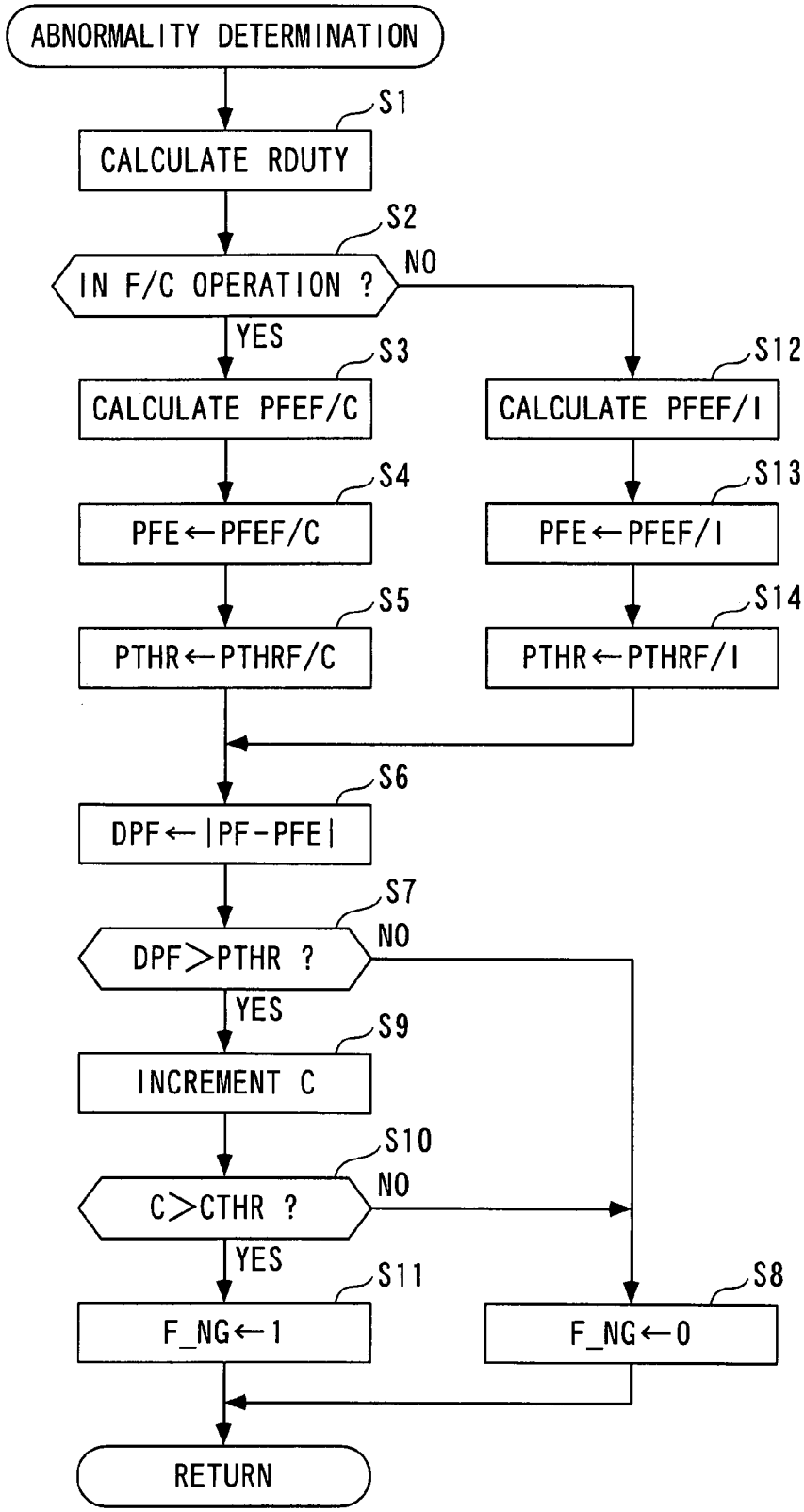
FIG. 2 is a flowchart showing an abnormality-determining process according to the first embodiment.

Next, the abnormality-determining process according to the first embodiment will be described with reference to FIG. 2. This process is executed whenever a predetermined time period (e.g. 10 msec.) elapses. First, in a step 1 (shown as S1 in abbreviated form in FIG. 1, and the following steps are also shown in abbreviated form), an electric current ratio RDUTY is calculated by dividing the metering valve duty ratio TDUTY by the relief valve duty ratio REDUTY. As mentioned hereinbefore, as the metering valve duty ratio TDUTY is higher, the inflow fuel amount is controlled to be smaller, while as the relief valve duty ratio TDUTY is higher, the outflow fuel amount is controlled to be smaller. Therefore, as the electric current ratio RDUTY, which is the ratio of the metering valve duty ratio TDUTY to the relief valve duty ratio REDUTY, assumes a higher value, it means that the outflow fuel amount increases relative to the inflow fuel amount. In other words, in the present embodiment, the metering valve duty ratio TDUTY corresponds to the inflow fuel amount parameter, the relief valve duty ratio REDUTY to the outflow fuel amount parameter, and the electric current ratio RDUTY to the fuel flow rate relationship parameter.

Figure 3:
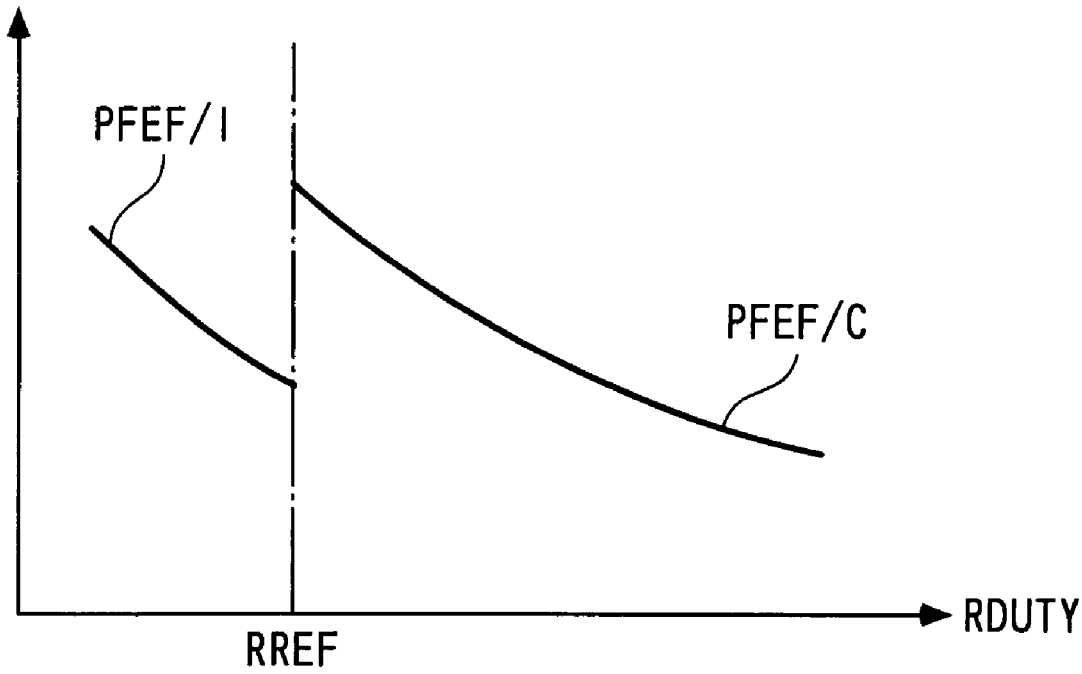
FIG. 3 is a diagram showing an example of a PFEF/C and PFEF/I table.

Next, it is determined whether or not the engine is in F/C operation (step 2), and if the engine is in F/C operation, abnormality determination for F/C operation is carried out in a step 3 et. seq. First, in the step 3, a normal-time fuel pressure PFEF/C for F/C operation is calculated by searing a PFEF/C table shown in FIG. 3 according to the calculated electric current ratio RDUTY. The PFEF/C table is formed in advance by empirically determining a value of fuel pressure to be detected when the fuel supply system is normal during F/C operation, according to the electric current ratio RDUTY, and setting the value to a normal-time fuel pressure PFEF/C. In the PFEF/C table, the normal-time fuel pressure PFEF for F/C operation is set to a lower value as the electric current ratio RDUTY is higher in a region where the electric current ratio RDUTY is not lower than a predetermined value RREF, which corresponds to an actual control region during F/C operation. This is because as the electric current ratio RDUTY increases, the outflow fuel amount increases with respect to the inflow fuel amount, which makes the fuel pressure lower.

Then, after setting the calculated normal-time fuel pressure PFEF/C for F/C operation to the normal-time fuel pressure PFE (step 4), a predetermined reference value PTHRF/C for F/C operation is set to a reference value PTHR (step 5). Next, the absolute value of the difference between the detected fuel pressure PF and the normal-time fuel pressure PFE is set to a differential pressure DPF (step 6), and it is determined whether or not the set differential pressure DPF is higher than the reference value PTHR (step 7).

If the answer to this question is negative (NO), i.e. if the difference between the detected fuel pressure PF and the normal-time fuel pressure PFE is small, it is determined that the fuel supply system is normal, and to indicate this fact, an abnormality flag F_NG is set to 0 (step 8), followed by terminating the present process.

On the other hand, if the answer to the question of the step 7 is affirmative (YES), i.e. if the difference between the detected fuel pressure PF and the normal-time fuel pressure PFE is large, there is a possibility that the fuel supply system is abnormal, and hence a count value C of a determination counter is incremented (step 9).

Next, it is determined whether or not the count value C is larger than a threshold value CTHR (e.g. 10) (step 10). If the answer to this question is affirmative (YES), i.e. if the number of times of occurrence of the state of the difference between the detected fuel pressure PF and the normal-time fuel pressure PFE being large is large, it is determined that the fuel supply system is abnormal, and to indicate this fact, the abnormality flag F_NG is set to 1 (step 11), followed by terminating the present process. During F/C operation, the abnormality determination is carried out as described above.

On the other hand, if the answer to the question of the step 2 is negative (NO), i.e. if the engine is not in F/C operation, but in normal operation, abnormality determination for normal operation is carried out in the following step 12 et seq. First, in the step 12, a normal-time fuel pressure PFEF/I for normal operation is calculated by searching a PFEF/I table shown in FIG. 3 according to the calculated electric current ratio RDUTY.

The PFEF/I table is formed in advance by empirically determining a value of fuel pressure to be detected when the fuel supply system is normal during normal operation, according to the electric current ratio RDUTY, and setting the value to a normal-time fuel pressure PFEF/I. In the PFEF/I table, the normal-time fuel pressure PFEF for normal operation is set in a region where the electric current ratio RDUTY is lower than the predetermined value RREF, which corresponds to an actual control region during normal operation, i.e. in a region where values of the electric current ratio RDUTY are lower than those for F/C operation, and the range of the values is narrower than that for F/C operation. This is because during normal operation, fuel injection is performed, and hence the outflow fuel amount is controlled to be smaller than during F/C operation.

Further, for the same reason as described above concerning the case of the normal-time fuel pressure PFEF/C for F/C operation, the normal-time fuel pressure PFEF/I for normal operation is similarly set to a lower value as the electric current ratio RDUTY is higher. Further, the normal-time fuel pressure PFEF/I for normal operation is set to a somewhat lower value than the normal-time fuel pressure PFEF/C for F/C operation. This is because during normal operation, the injectors 4 perform fuel injection, and the fuel pressure lowers accordingly, so that the fuel pressure becomes lower with respect to the same electric current ratio RDUTY than during F/C operation.

Next, the normal-time fuel pressure PFEF/I for normal operation calculated in the step 12 is set to the normal-time fuel pressure PFE (step 13), and then a predetermined reference value PTHRF/I for normal operation is set to the reference value PTHR (step 14). Next, the aforementioned step 6 et seq. are executed to determine abnormality based on the result of comparison between the normal-time fuel pressure PFE and the detected fuel pressure PF.

The aforementioned reference value PTHRF/I for normal operation is set to a higher value than the reference value PTHRF/C for F/C operation. This is because during normal operation, the fuel pressure is more likely to fluctuate than during F/C operation, due to execution of fuel injection by the injectors 4, and hence is for the purposes of prevention of an erroneous determination which might be caused by the fluctuation.

As described above, according to the present embodiment, the electric current ratio RDUTY as the ratio of the metering valve duty ratio TDUTY to the relief valve duty ratio REDUTY is used as the fuel flow rate relationship parameter, to thereby set the normal-time fuel pressure PFEF/C or PFEF/I. Further, based on the result of comparison between the detected fuel pressure PF and the normal-time fuel pressure PFE corresponding to the electric current ratio calculated when the detected fuel pressure PF is detected, abnormality of the fuel supply system is determined. This makes it possible to carry out the determination with accuracy. Further, the normal-time fuel pressure PFEF/C for F/C operation and the normal-time pressure value PFEF/I for normal operation are set, and the detected fuel pressure PF is compared with one of the normal-time fuel pressures PFE corresponding to the operative state of the engine detected when the detected fuel pressure PF is detected. This makes it possible to carry out the determination accurately according to the operative state of the engine 3.

Further, since the electric current ratio RDUTY is used as a parameter for setting the normal-time fuel pressure PFEF/C or PFEF/I, it is possible to determine a wide range of abnormality of the fuel supply system which affects the relationship between the metering valve duty ratio TDUTY and the relief valve duty ratio REDUTY, and the fuel pressure. More specifically, it is possible to determine various kinds of abnormality of the fuel supply system except that of the fuel tank 6, including, to say nothing of abnormality of the fuel pressure valve 21, abnormality of any of the injectors 4, the high-pressure pump 10, the fuel metering valve 10*a*, the low-pressure pump 11, and the electromagnetic valve relief valve 13, cracking of any of the fuel supply passage 7, the fuel return passage 8, the common rail 9, and the fuel injection passages 14, and so forth.

Figure 4:
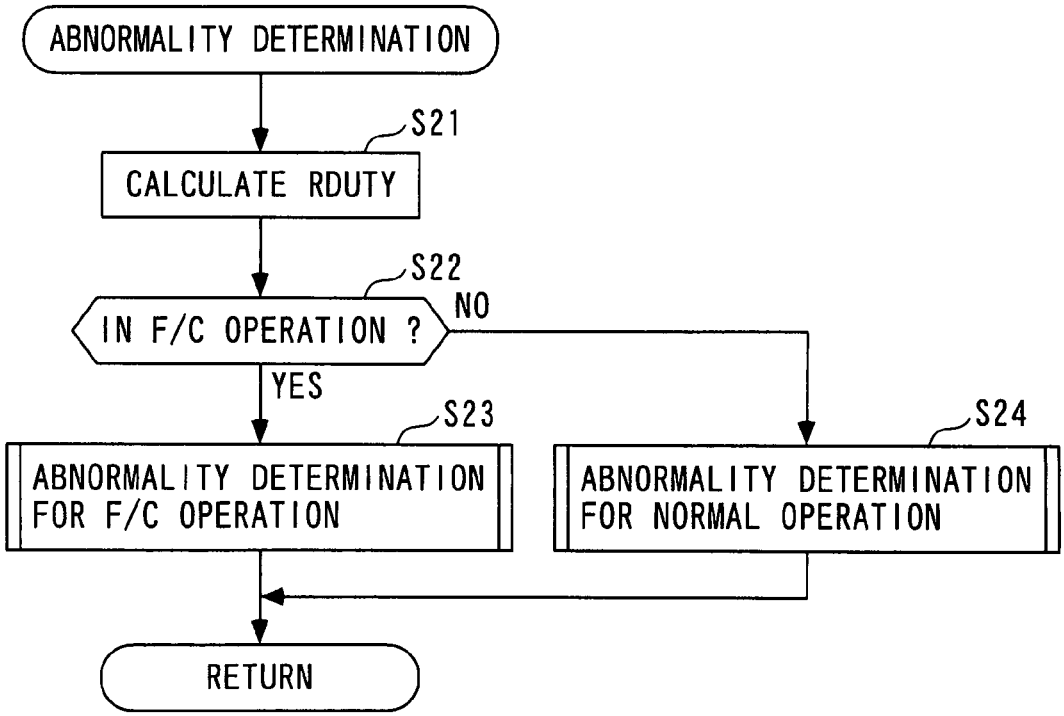
FIG. 4 is a flowchart showing an abnormality-determining process according a second embodiment of the present invention.

Next, an abnormality-determining process according to a second embodiment of the present invention will be described with reference to FIG. 4. First, in a step 21, similarly to the step 1, the electric current ratio RDUTY is calculated. Then, it is determined whether or not the engine is in F/C operation (step 22). If the answer to this question is affirmative (YES), i.e. if the engine is in F/C operation, an abnormality-determining process for F/C operation is executed (step 23), whereas if the answer is negative (NO), i.e. if the engine is in normal operation, an abnormality-determining process for normal operation is executed (step 24), followed by terminating the present process.

Figure 5:
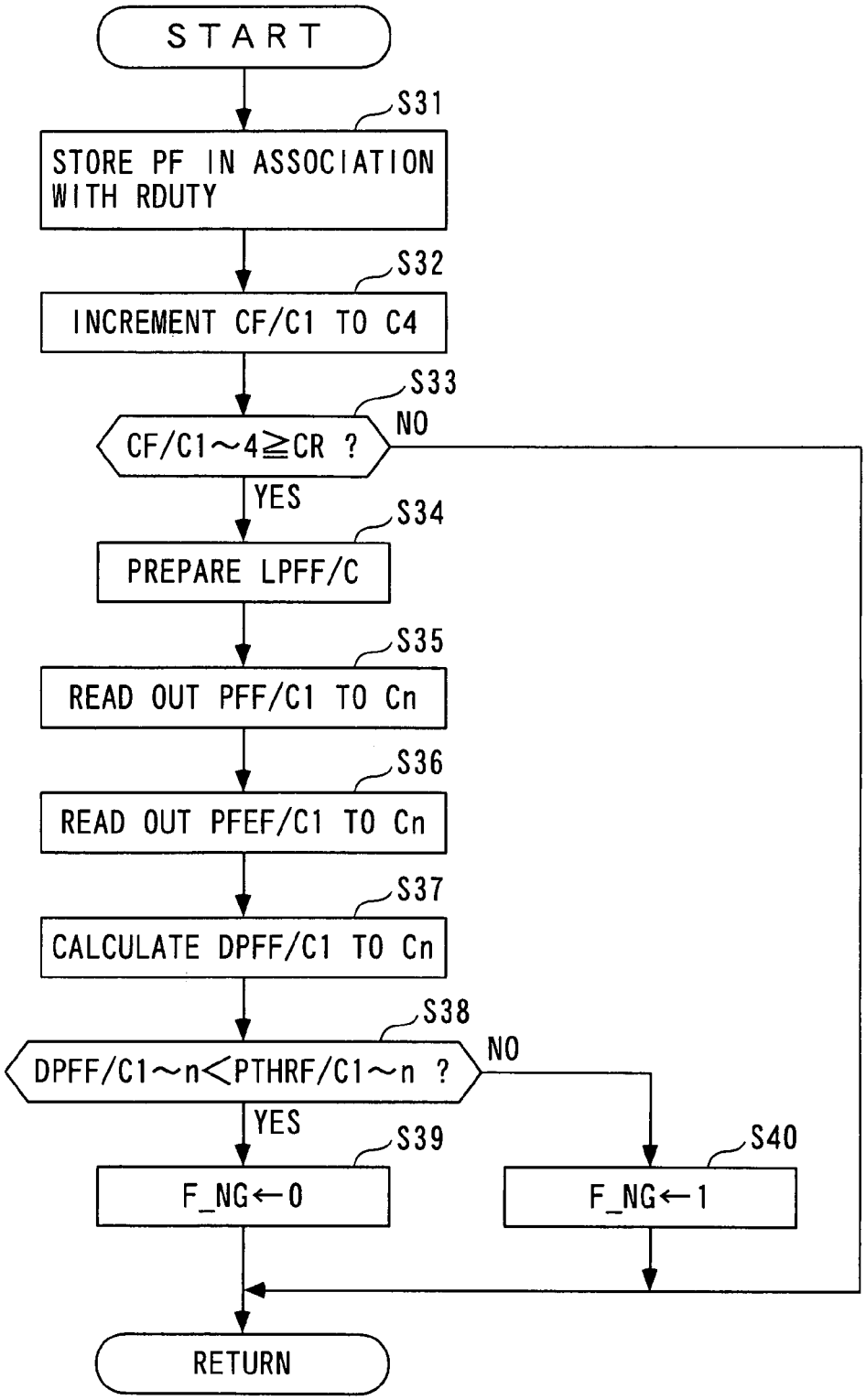
FIG. 5 is a flowchart showing an abnormality-determining process for F/C operation, executed in a step 23 in FIG. 4.

FIG. 5 shows the abnormality-determining process for F/C operation. First, in a step 31, a value of the detected fuel pressure PF is stored in a PFE/C memory for F/C operation, in association with the current value of the electric current ratio RDUTY. Then, it is determined to which of predetermined first to fourth regions A1 to A4 (see FIG. 6) formed by equally dividing the control region of the electric current ratio RDUTY during F/C operation, the current value of the electric current ratio RDUTY belongs, and one of first to fourth count values CF/C1 to C4 of first to fourth counters respectively associated with the regions A1 to A4, which corresponds to one of the regions A1 to A4 to which the current value of the electric current ratio RDUTY is determined to belong, is incremented (step 32). This causes the counter values CF/C1 to C4 to represent the respective numbers of values or data items of the detected fuel pressure PF stored in association with the first to fourth regions A1 to A4.

Figure 6:
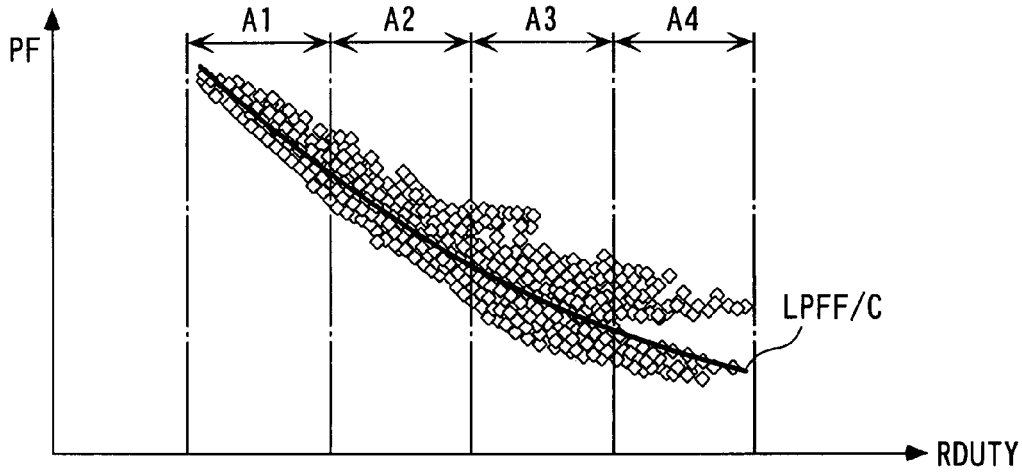
FIG. 6 is a diagram useful in explaining a method of forming a detected pressure curve LPFF/C.

Next, it is determined whether or not all the count values CF/C1 to C4 are all not smaller than a predetermined threshold value CR (e.g. 100) (step 33). If the answer to this question is negative (NO), the present process is immediately terminated. On the other hand, if the answer to this question is affirmative (YES), i.e. if the respective numbers of data items of the detected fuel pressure PF stored in association with the first to fourth regions A1 to A4 reach the threshold value CR are all larger than the threshold value CR, a detected pressure curve LPFF/C is formed (step 34). As shown in FIG. 6, the detected pressure curve LPFF/C is formed by the least-squares method using a large number of stored data items of the detected fuel pressure PF and values of the electric current ratio RDUTY associated therewith such that the relationship between the detected fuel pressure PF and the electric current ratio RDUTY is represented on average as a whole.

Next, from the formed detected pressure curve LPFF/C, values of the detected fuel pressure PF corresponding to the predetermined first to n-th electric current ratios RDUTYF/C1 to Cn, respectively, are read out as the first to n-th detected fuel pressures PFF/C1 to Cn (step 35). Here, n is 10, for example, and as n is larger, it shows that the electric current ratio is higher, and the first to n-th electric current ratios RDUTYF/C1 to Cn are set in a manner equally dividing the whole of the first to fourth regions A1 to A4. Next, from the aforementioned PFEF/C table, the first to n-th normal-time fuel pressures PFEF/C1 to Cn corresponding to the aforementioned first to n-th electric current ratios RDUTYF/C1 to Cn, respectively, are read out (step 36).

Next, the absolute values of the differences between the first to n-th detected fuel pressure PFF/C1 to Cn calculated as described above and the first to n-th normal-time pressures PFEF/C1 to Cn are calculated as first to n-th differential pressures DPFF/C1 to Cn (step 37). Next, it is determined whether or not the first to n-th differential pressures DPFF/C1 to Cn are lower than respective associated predetermined first to n-th reference values PTHRF/C1 to Cn (step 38). This determination is to determine whether or not the whole of the detected fuel pressure curve LPFF/C is within a normal-time pressure region indicated by broken lines in FIG. 7 which are defined based on the normal-time fuel pressures PFEF/C1 to Cn and the reference values PTHRF/C1 to Cn.

If the answer to the question of the step 38 is affirmative (YES), i.e. if all the first to n-th differential pressures DPFF/C1 to Cn are lower than the respective reference values PTHRF/C1 to Cn, it means that the detected pressure curve LPFF/C is within the normal-time pressure region. Therefore, it is determined that the fuel supply system is normal, and an abnormality flag F_NG is set to 0 (step 39), followed by terminating the present process.

On the other hand, if the answer to the question of the step 38 is negative (NO), at least part of the detected pressure curve LPFF/C is outside the normal-time pressure region. Therefore, it is determined that the fuel supply system is abnormal, and hence the abnormality flag F_NG is set to 1 (step 40), followed by terminating the present process.

Figure 7:
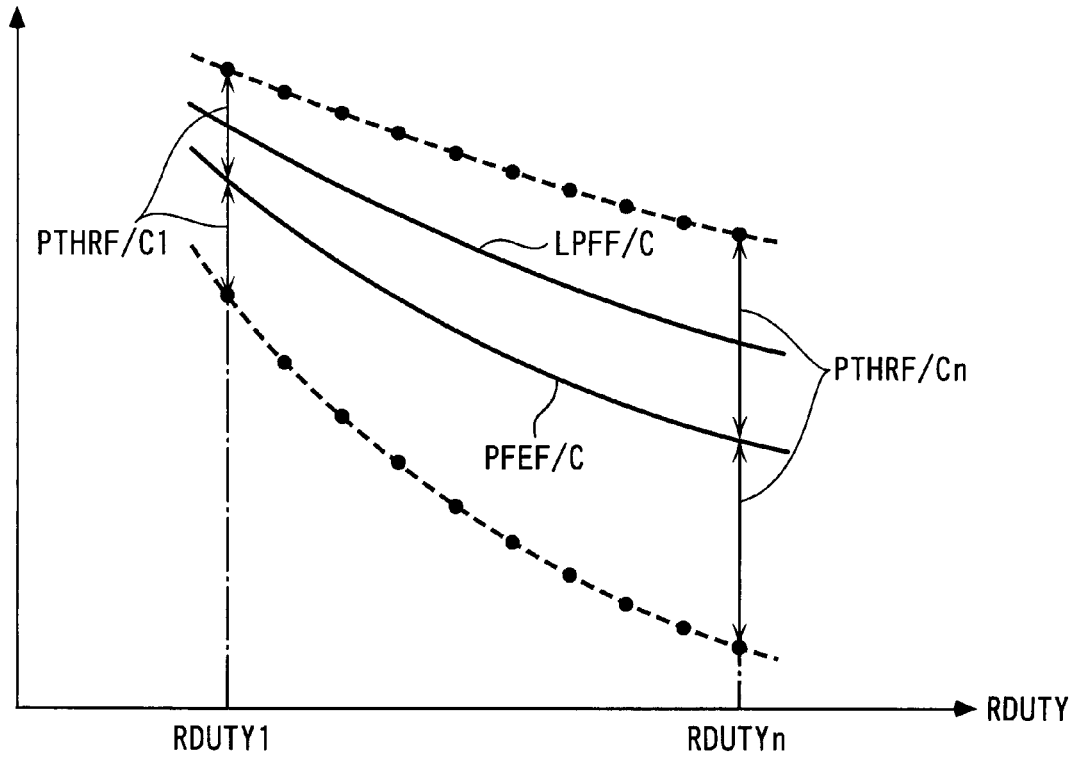
FIG. 7 is a diagram showing a normal-time pressure region for F/C operation.

It should be noted as shown in FIG. 7, the first to n-th reference values PTRF/C1 to Cn are set to higher values as the electric current ratio RDUTY is higher. This is because when the electric current ratio RDUTY is high, the relief valve duty ratio REDUTY is relatively low, so that the electric current ratio TDUTY tends to largely change with respect to a change in the metering valve duty ratio TDUTY, and accordingly, even if the fuel supply system is normal, the actual fuel pressure tends to vary with respect to the electric duty ratio RDUTY.

Figure 8:
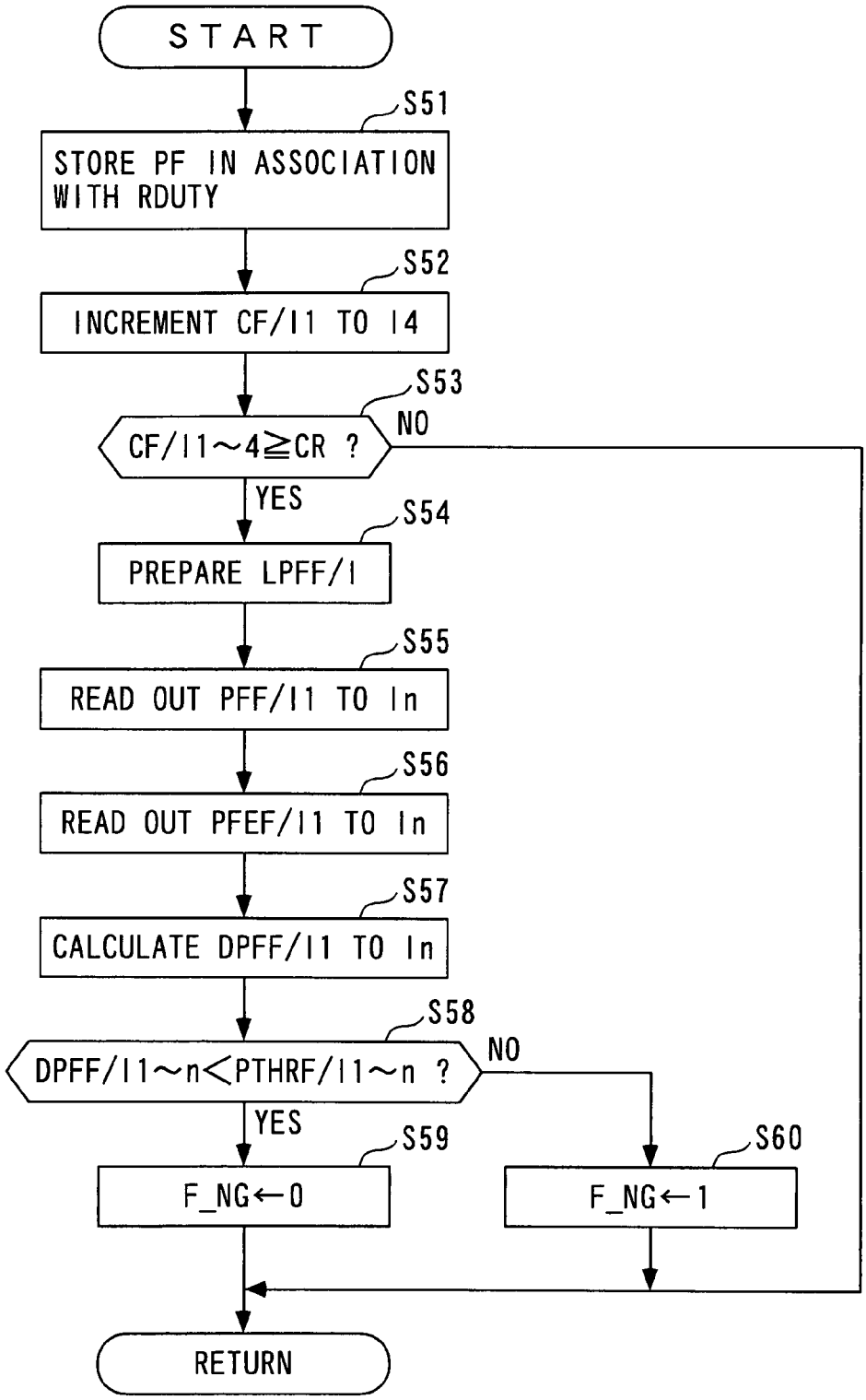
FIG. 8 is a flowchart showing an abnormality-determining process for normal operation, executed in a step 24 in FIG. 4.

FIG. 8 shows the abnormality-determining process for normal operation which is executed in the step 24. This process is carried out substantially in the same manner as the abnormality-determining process for F/C operation described above, and hence it is briefly described.

First, a value of the detected fuel pressure PF is stored in the PFF/I memory for normal operation in association with the electric current ratio RDUTY (step 51). Then, it determined, similarly to the step 32, to which of predetermined first to fourth regions a1 to a4 (not shown) formed by equally dividing the control region of the electric current ratio RDUTY during normal operation, the current value of the electric current ratio RDUTY belongs, and one of first to fourth count values CF/I1 to I4 of first to fourth counters respectively associated with the regions a1 to a4, which corresponds to one of the regions a1 to a4 to which the current value of the electric current ratio RDUTY is determined to belong, is incremented (step 52). Then, if the number of data items of the detected fuel pressure PF stored in association with the first to fourth regions a1 to a4 are larger than the threshold valve CR (Yes to step 53), a detected pressure curve LPFF/I is formed using these value of the detected fuel pressure PF similarly to the step 34 (step 54).

Next, from the detected pressure curve LPFF/I, values of the detected pressure PF corresponding to the aforementioned first to n-th electric current ratios RDUTYF/I1 to In, respectively, are read out (step 55). Then, from the aforementioned PFEF/I table, values of the first to n-th normal-time fuel pressures PFEF/I1 to In corresponding to the aforementioned first to n-th electric current ratios RDUTYF/I1 to In, respectively, are read out (step 56). It should be noted that the first to n-th electric current ratios RDUTYF/I1 to In are set in a manner equally dividing the whole of the first to fourth regions a1 to a4.

Next, the absolute values of the differences between the first to n-th detected fuel pressures PFF/I1 to In calculated as described above and the associated first to n-th normal-time fuel pressures PFEF/I1 to In are calculated as the first to n-th differential pressures DPFF/I1 to In (step 57). Then, it is determined whether or not the first to n-th differential pressures DPFF/I1 to In are lower than respective associated predetermined first to n-th reference values PTHRF/I1 to In (step 58).

These reference value PTHRF/I1 to In are generally set to higher values than the reference values PTHRF/C1 to Cn for F/C operation. This is because, as described above, during normal operation, the fuel pressure is more likely to fluctuate than during F/C operation, due to execution of fuel injection by the injectors 4, and is for the purpose of prevention of an erroneous determination which might be caused by the fluctuation.

If the answer to the question of the step 58 is affirmative (YES), and all the differential pressures DPFF/I1 to In are lower than the respective reference values PTHRF/I1 to In, it means that the detected pressure curve LPFF/I is within the normal-time pressure region, and hence it is determined that the fuel supply system is normal, and the abnormality flag F_NG is set to 0 (step 59), followed by terminating the present process. On the other hand, if the answer to the question of the step 58 is negative (NO), it means that at least part of the detected pressure curve LPFF/I is outside the normal-time pressure region. Therefore, it is determined that the fuel supply system is abnormal, and the abnormality flag F_NG is set to 1 (step 60), followed by terminating the present process.

As described above, according to the present embodiment, abnormality is determined based on the result of comparison between the detected pressure curve LPFF/I or LPFF/C formed based on a large number of data items of the detected fuel pressure PF, and the normal-time fuel pressures PFEF/I or PFEF/C, it is possible to carry out the determination more accurately while excluding the direct affects of temporary fluctuations in the inflow fuel amount, the outflow fuel amount, and the fuel pressure, and temporary errors in the detected fuel pressure PF.

Further, the detected pressure curves LPFF/I and LPFF/C are formed for respective operative states concerning whether the F/C operation is being performed, and compared with ones of the normal-time fuel pressures PFEF/I and PFEF/C, which are associated with the corresponding operative states. This makes it possible to perform the abnormality determination accurately depending on the operating conditions of the engine 3. Further, it is determined that the fuel supply system is abnormal when at least part of the detected pressure curve LPFF/I or LPFF/C is outside the normal-time pressure region defined by the normal-time fuel pressure PFEF/I or PFEF/C and the reference value PTHRF/I1 to In or PTHRF/C1 to Cn. This makes it possible to carry out the abnormality determination while taking variation in the fuel pressure into account. Furthermore, as described hereinbefore, when the electric current ratio RDUTY is higher, the actual fuel pressure is more likely to fluctuate with respect to the electric current ratio RDUTY, and hence the reference values PTHRF/I1 to In and PTHRF/C1 to Cn are set to higher values as the electric current ratio RDUTY is higher, whereby it is possible to perform the abnormality determination more accurately.

It should be noted that the present invention is not limited to the embodiment described above, but can be practices in various forms. For example, although in the first and second embodiments, the metering valve duty ratio TDUTY and the relief valve duty ratio REDUTY are used as the inflow fuel amount parameter and the outflow fuel amount parameter, this is not limitative, but other appropriate parameters which represent the inflow fuel amount and the outflow fuel amount, e.g. values thereof directly detected by respective sensors, may be used.

Further, although in the second embodiment, the normal-time pressure regions are defined by the normal-time fuel pressures PFEF/I and PFEF/C, and the reference values PTHRF/I and PTHRF/C, this is not limitative, but they may be defined in the following manner: Upper and lower limit values of the normal-time fuel pressures PFEF/I and PFEF/C are set in advance according to the electric current ratio RDUTY, and the normal-time pressure regions may be defined by these upper and lower limit values. Further, although in the second embodiment, determination as to whether or not the detected pressure curve LPFF/I or LPFF/C extends off the normal-time pressure region is carried out by determining whether or not at least one of the differential pressure DPFF/I1 to In or DPF/C1 to Cn is higher than the associated one of the reference values PTHRF/I1 to In and PTHRF/C1 to Cn. The manner of the determination can be set as desired. For example, the reference values PTHRF/I1 to In and PTHRF/C1 to Cn are set to lower values, and if all or almost all of the differential pressures DPFF/I1 to In or DPFF/C1 to Cn exceed the associated reference values PTHRF/I1 to In or PTHRF/C1 to Cn, the fuel supply system may be determined to be normal.

Further, although the above-described embodiments are examples of the present invention being applied to the fuel supply system of diesel engine, this is not limitative, but the present invention may be applied to the fuel supply system of various types of engine other than the diesel engine, e.g. a gasoline engine, and a ship propulsion engine, such as an outboard engine, which has a vertically-installed crankshaft.

It is further understood by those skilled in the art that the foregoing is a preferred embodiment of the invention, and that various changes and modifications may be made without departing from the spirit and scope thereof.

What is claimed is:

1. A device for determining abnormality of a fuel supply system that supplies fuel in a fuel tank to an accumulator via a fuel pump, and supplies fuel stored under pressure in the accumulator to an internal combustion engine, the fuel supply system including a relief mechanism for returning fuel in the accumulator to the fuel tank, and a fuel pressure sensor for detecting the pressure of the fuel in the accumulator as detected fuel pressure, comprising:

inflow fuel amount parameter-detecting means for detecting an inflow fuel amount parameter indicative of an inflow fuel amount of fuel flowing into the accumulator from the fuel tank;

outflow fuel amount parameter-detecting means for detecting an outflow fuel amount parameter indicative of an outflow fuel amount of fuel flowing out of the accumulator into the fuel tank;

fuel flow rate relationship parameter-calculating means for calculating a fuel flow rate relationship parameter indicative of a relationship between the inflow fuel amount parameter and the outflow fuel amount parameter;

normal-time fuel pressure-calculating means for calculating a normal-time fuel pressure indicative of a pressure of fuel in the accumulator which is to be detected when the fuel supply system is normal, according to the calculated fuel flow rate relationship parameter; and abnormality determining means for determining abnormality of the fuel supply system, based on a result of comparison between the detected fuel pressure detected by the fuel pressure sensor and the calculated normal-time fuel pressure.

2. A device as claimed in claim 1, further comprising operative state-determining means for determining which of a normal operation in which the fuel supply system supplies fuel to the engine and a fuel-cut operation in which the supply of fuel to the engine is inhibited the engine is in, and wherein said normal-time fuel pressure-calculating means calculates the normal-time fuel pressure according to the determined operative state of the engine.

3. A device for determining abnormality of a fuel supply system that supplies fuel in a fuel tank to an accumulator via a fuel pump, and supplies fuel stored under pressure in the accumulator to an internal combustion engine, the fuel supply system including a relief mechanism for returning fuel in the accumulator to the fuel tank, and a fuel pressure sensor for detecting the pressure of the fuel in the accumulator as detected fuel pressure, comprising:

inflow fuel amount parameter-detecting means for detecting an inflow fuel amount parameter indicative of an inflow fuel amount of fuel flowing into the accumulator from the fuel tank;

outflow fuel amount parameter-detecting means for detecting an outflow fuel amount parameter indicative of an outflow fuel amount of fuel flowing out of the accumulator into the fuel tank;

fuel flow rate relationship parameter-calculating means for calculating a fuel flow rate relationship parameter indicative of a relationship between the inflow fuel amount parameter and the outflow fuel amount parameter;

detected pressure curve-calculating means for calculating a detected pressure curve indicative of a relationship between the fuel flow rate relationship parameter and the detected fuel pressure, based on a plurality of detected fuel pressures detected by the fuel pressure sensor, and the fuel flow rate relationship parameters which are calculated when the detected fuel pressures are detected, respectively;

normal-time pressure curve-setting means for setting a predetermined normal-time pressure curve indicative of a relationship between the fuel flow rate relationship parameter and a normal-time fuel pressure indicative of a pressure of fuel in the accumulator which is to be detected when the fuel supply system is normal; and abnormality determining means for determining abnormality of the fuel supply system, based on a result of comparison between the detected fuel pressure curve and the normal-time pressure curve.

4. A device as claimed in claim 3, further comprising operative state-determining means for determining which of a normal operation in which the fuel supply system supplies fuel to the engine and a fuel-cut operation in which the supply of fuel to the engine is inhibited the engine is in, and wherein said detected pressure curve-calculating means calculates the detected fuel pressure curve, on an operative state-by-operative state basis, according to the operative state determined by said operative state-determining means when the detected fuel pressure is detected, wherein said normal-time pressure curve-setting means sets the normal-time pressure curve, on an operative state-by-operative state basis, and wherein said abnormality determining means compares between one of the detected pressure curves and one of the normal-time pressure curves, the ones corresponding to each other in respect of the operative state of the engine.

5. A device as claimed in claim 3 or 4, further comprising normal-time pressure region-setting means for setting a predetermined normal-time pressure region including the normal-time pressure curve, based on the normal-time pressure curve, and wherein said abnormality determining means determines that the fuel supply system is abnormal when at least part of the detected pressure curve is outside the normal-time pressure region.

6. A device as claimed in claim 5, wherein the normal-time pressure region has a range of pressure set according to the fuel flow rate relationship parameter.

7. A method of determining abnormality of a fuel supply system that supplies fuel in a fuel tank to an accumulator via a fuel pump, and supplies fuel stored under pressure in the accumulator to an internal combustion engine, the fuel supply system including a relief mechanism for returning fuel in the accumulator to the fuel tank, and a fuel pressure sensor for detecting the pressure of the fuel in the accumulator as detected fuel pressure, comprising:

an inflow fuel amount parameter-detecting step of detecting an inflow fuel amount parameter indicative of an inflow fuel amount of fuel flowing into the accumulator from the fuel tank;

an outflow fuel amount parameter-detecting step of detecting an outflow fuel amount parameter indicative of an outflow fuel amount of fuel flowing out of the accumulator into the fuel tank;

a fuel flow rate relationship parameter-calculating step of calculating a fuel flow rate relationship parameter indicative of a relationship between the inflow fuel amount parameter and the outflow fuel amount parameter;

a normal-time fuel pressure-calculating step of calculating a normal-time fuel pressure indicative of a pressure of fuel in the accumulator which is to be detected when the fuel supply system is normal, according to the calculated fuel flow rate relationship parameter; and an abnormality determining step of determining abnormality of the fuel supply system, based on a result of comparison between the detected fuel pressure detected by the fuel pressure sensor and the calculated normal-time fuel pressure.

8. A method as claimed in claim 7, further comprising an operative state-determining step of determining which of a normal operation in which the fuel supply system supplies fuel to the engine and a fuel-cut operation in which the supply of fuel to the engine is inhibited the engine is in, and wherein said normal-time fuel pressure-calculating step includes calculating the normal-time fuel pressure according to the determined operative state of the engine.

9. A method of determining abnormality of a fuel supply system that supplies fuel in a fuel tank to an accumulator via a fuel pump, and supplies fuel stored under pressure in the accumulator to an internal combustion engine, the fuel supply system including a relief mechanism for returning fuel in the accumulator to the fuel tank, and a fuel pressure sensor for detecting the pressure of the fuel in the accumulator as detected fuel pressure, comprising:

an inflow fuel amount parameter-detecting step of detecting an inflow fuel amount parameter indicative of an inflow fuel amount of fuel flowing into the accumulator from the fuel tank;

an outflow fuel amount parameter-detecting step of detecting an outflow fuel amount parameter indicative of an outflow fuel amount of fuel flowing out of the accumulator into the fuel tank;

a fuel flow rate relationship parameter-calculating step of calculating a fuel flow rate relationship parameter indicative of a relationship between the inflow fuel amount parameter and the outflow fuel amount parameter;

a detected pressure curve-calculating step of calculating a detected pressure curve indicative of a relationship between the fuel flow rate relationship parameter and the detected fuel pressure, based on a plurality of detected fuel pressures detected by the fuel pressure sensor, and the fuel flow rate relationship parameters which are calculated when the detected fuel pressures are detected, respectively;

a normal-time pressure curve-setting step of setting a predetermined normal-time pressure curve indicative of a relationship between the fuel flow rate relationship parameter and a normal-time fuel pressure indicative of a pressure of fuel in the accumulator which is to be detected when the fuel supply system is normal; and an abnormality determining step of determining abnormality of the fuel supply system, based on a result of comparison between the detected fuel pressure curve and the normal-time pressure curve.

10. A method as claimed in claim 9, further comprising an operative state-determining step of determining which of a normal operation in which the fuel supply system supplies fuel to the engine and a fuel-cut operation in which the supply of fuel to the engine is inhibited the engine is in, and wherein said detected pressure curve-calculating step includes calculating the detected fuel pressure curve, on an operative state-by-operative state basis, according to the operative state determined in said operative state-determining step when the detected fuel pressure is detected, wherein said normal-time pressure curve-setting step includes setting the normal-time pressure curve, on an operative state-by-operative state basis, and wherein said abnormality determining step includes comparing between one of the detected pressure curves and one of the normal-time pressure curves, the ones corresponding to each other in respect of the operative state of the engine.

11. A method as claimed in claim 9 or 10, further comprising a normal-time pressure region-setting step of setting a predetermined normal-time pressure region including the normal-time pressure curve, based on the normal-time pressure curve, and wherein said abnormality determining step includes determining that the fuel supply system is abnormal when at least part of the detected pressure curve is outside the normal-time pressure region.

12. A method as claimed in claim 11, wherein the normal-time pressure region has a range of pressure set according to the fuel flow rate relationship parameter.

13. An engine control unit including a control program for causing a computer to determine abnormality of a fuel supply system that supplies fuel in a fuel tank to an accumulator via a fuel pump, and supplies fuel stored under pressure in the accumulator to an internal combustion engine, the fuel supply system including a relief mechanism for returning fuel in the accumulator to the fuel tank, and a fuel pressure sensor for detecting the pressure of the fuel in the accumulator as detected fuel pressure, wherein the control program causes the computer to detect an inflow fuel amount parameter indicative of an inflow fuel amount of fuel flowing into the accumulator from the fuel tank, detect an outflow fuel amount parameter indicative of an outflow fuel amount of fuel flowing out of the accumulator into the fuel tank, calculate a fuel flow rate relationship parameter indicative of a relationship between the inflow fuel amount parameter and the outflow fuel amount parameter, calculate a normal-time fuel pressure indicative of a pressure of fuel in the accumulator which is to be detected when the fuel supply system is normal, according to the calculated fuel flow rate relationship parameter, and determine abnormality of the fuel supply system, based on a result of comparison between the detected fuel pressure detected by the fuel pressure sensor and the calculated normal-time fuel pressure.

14. An engine control unit as claimed in claim 13, wherein the control program causes the computer to determine which of a normal operation in which the fuel supply system supplies fuel to the engine and a fuel-cut operation in which the supply of fuel to the engine is inhibited the engine is in, and wherein when the control program causes the computer to calculate the normal-time fuel pressure, the control program causes the computer to calculate the normal-time fuel pressure according to the determined operative state of the engine.

15. An engine control unit including a control program for causing a computer to determine abnormality of a fuel supply system that supplies fuel in a fuel tank to an accumulator via a fuel pump, and supplies fuel stored under pressure in the accumulator to an internal combustion engine, the fuel supply system including a relief mechanism for returning fuel in the accumulator to the fuel tank, and a fuel pressure sensor for detecting the pressure of the fuel in the accumulator as detected fuel pressure, wherein the control program causes the computer to detect an inflow fuel amount parameter indicative of an inflow fuel amount of fuel flowing into the accumulator from the fuel tank, detect an outflow fuel amount parameter indicative of an outflow fuel amount of fuel flowing out of the accumulator into the fuel tank, calculate a fuel flow rate relationship parameter indicative of a relationship between the inflow fuel amount parameter and the outflow fuel amount parameter, calculate a detected pressure curve indicative of a relationship between the fuel flow rate relationship parameter and the detected fuel pressure, based on a plurality of detected fuel pressures detected by the fuel pressure sensor, and the fuel flow rate relationship parameters which are calculated when the detected fuel pressures are detected, respectively, set a predetermined normal-time pressure curve indicative of a relationship between the fuel flow rate relationship parameter and a normal-time fuel pressure indicative of a pressure of fuel in the accumulator which is to be detected when the fuel supply system is normal, and determine abnormality of the fuel supply system, based on a result of comparison between the detected fuel pressure curve and the normal-time pressure curve.

16. An engine control unit as claimed in claim 15, wherein the control program causes the computer to determine which of a normal operation in which the fuel supply system supplies fuel to the engine and a fuel-cut operation in which the supply of fuel to the engine is inhibited the engine is in, and wherein when the control program causes the computer to calculate the detected pressure curve, the control program causes the computer to calculate the detected fuel pressure curve, on an operative state-by-operative state basis, according to the operative state determined by said operative state-determining means when the detected fuel pressure is detected, wherein when the control program causes the computer to set the normal-time pressure curve, the control program causes the computer to set the normal-time pressure curve, on an operative state-by-operative state basis, and wherein when the control program causes the computer to determine the abnormality, the control program causes the computer to compare between one of the detected pressure curves and one of the normal-time pressure curves, the ones corresponding to each other in respect of the operative state of the engine.

17. An engine control unit as claimed in claim 15 or 16, wherein the control program causes the computer to set a predetermined normal-time pressure region including the normal-time pressure curve, based on the normal-time pressure curve, and wherein when the control program causes the computer to determine the abnormality, the control program causes the computer to determine that the fuel supply system is abnormal when at least part of the detected pressure curve is outside the normal-time pressure region.

18. An engine control unit as claimed in claim 17, wherein the normal-time pressure region has a range of pressure set according to the fuel flow rate relationship parameter.

* * * * *